US009531058B2

(12) United States Patent
Isohätälä

(10) Patent No.: US 9,531,058 B2
(45) Date of Patent: Dec. 27, 2016

(54) LOOSELY-COUPLED RADIO ANTENNA APPARATUS AND METHODS

(75) Inventor: Anne Isohätälä, Kello (FI)

(73) Assignee: PULSE FINLAND OY (FI)

( * ) Notice: Subject to any disclaimer, the term of this patent is extended or adjusted under 35 U.S.C. 154(b) by 793 days.

(21) Appl. No.: 13/331,802

(22) Filed: Dec. 20, 2011

(65) Prior Publication Data

US 2013/0154886 A1 Jun. 20, 2013

(51) Int. Cl.

| | |
|---|---|
| ***H01Q 1/24*** | (2006.01) |
| ***H01Q 9/04*** | (2006.01) |
| ***H01Q 5/371*** | (2015.01) |
| ***H01Q 5/378*** | (2015.01) |

(52) U.S. Cl.

CPC ..... *H01Q 1/243* (2013.01); *H01Q 5/371* (2015.01); *H01Q 5/378* (2015.01); *H01Q 9/045* (2013.01); *H01Q 9/0421* (2013.01)

(58) Field of Classification Search

CPC ..... H01Q 1/38; H01Q 1/48; H01Q 9/0421
USPC ..... 343/702, 846, 848
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |

(Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

"An Adaptive Microstrip Patch Antenna For Use in Portable Transceivers", Rostbakken et al., Vehicular Technology Conference, 1996, Mobile Technology For The Human Race, pp. 339-343.

(Continued)

*Primary Examiner* — Dameon E Levi
*Assistant Examiner* — Collin Dawkins
(74) *Attorney, Agent, or Firm* — Gazdzinski & Associates, PC

(57) ABSTRACT

A multiband internal antenna apparatus and methods of tuning and utilizing the same. In one embodiment, the antenna configuration is used within a handheld mobile device (e.g., cellular telephone or smartphone). The device enclosure is fabricated from a conductive material and has two parts: the main portion, housing the device electronics and ground plane, and the antenna cap, which substantially envelops a directly fed radiator structure of the antenna. Electromagnetic coupling of the cap portion to the device feed effects formation of a parasitic antenna radiator in a lower frequency band. The cap portion is separated from the main portion by a narrow gap, extending along circumference of the device, and is grounded at a location selected to cause desired resonance and to widen antenna bandwidth. In one implementation, a second parasitic radiator is disposed proximate the directly feed radiator to further expand antenna frequency bands of operation.

23 Claims, 5 Drawing Sheets

(56) References Cited

U.S. PATENT DOCUMENTS 4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaisaenen
5,061,939 A 10/1991 Nakase
5,097,236 A 3/1992 Wakino et al.
5,103,197 A 4/1992 Turunen et al.
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten

(56) References Cited

U.S. PATENT DOCUMENTS 5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,108 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell et al.
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai et al.
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor

(56) References Cited

U.S. PATENT DOCUMENTS 6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavlejevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Perunka et al.
7,616,158 B2 11/2009 Mark et al.
7,626,832 B2 * 12/2009 Muramatsu et al. ..... 361/818
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2003/0184479 A1 * 10/2003 Collins ..... 343/700 MS
2004/0090378 A1 5/2004 Dai et al.
2004/0137950 A1 7/2004 Bolin et al.
2004/0145525 A1 7/2004 Annabi et al.
2004/0150561 A1 * 8/2004 Tillery ..... H01Q 1/085 343/700 MS
2004/0171403 A1 9/2004 Mikkola
2004/0222926 A1 * 11/2004 Kontogeorgakis ..... H01Q 1/243 343/702
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0170600 A1 * 8/2006 Korva ..... 343/702
2006/0176225 A1 * 8/2006 Annamaa ..... H01Q 1/242 343/702
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2008/0055164 A1 3/2008 Zhang et al.
2008/0059106 A1 3/2008 Wight
2008/0088511 A1 4/2008 Sorvala
2008/0129630 A1 * 6/2008 Baliarda ..... H01Q 1/36 343/793
2008/0143611 A1 * 6/2008 Wang ..... 343/702
2008/0266199 A1 10/2008 Milosavljevic
2008/0284661 A1 * 11/2008 He ..... 343/700 MS
2009/0009415 A1 1/2009 Tanska
2009/0046022 A1 * 2/2009 Desclos ..... H01Q 1/362 343/702
2009/0135066 A1 5/2009 Raappana et al.
2009/0153412 A1 6/2009 Chiang et al.
2009/0160713 A1 6/2009 Nielsen et al.
2009/0174604 A1 * 7/2009 Keskitalo ..... H01Q 1/243 343/700 MS
2009/0196160 A1 8/2009 Crombach
2009/0197654 A1 8/2009 Teshima
2009/0231213 A1 9/2009 Ishimiya
2009/0303135 A1 * 12/2009 Reed et al. ..... 343/702
2010/0156742 A1 * 6/2010 Yanagi et al. ..... 343/846

(56) References Cited

U.S. PATENT DOCUMENTS

| | | | | |
|---|---|---|---|---|
| 2010/0177012 | A1* | 7/2010 | Morrow | H01Q 21/0025 343/893 |
| 2010/0220016 | A1 | 9/2010 | Nissinen | |
| 2010/0244978 | A1 | 9/2010 | Milosavljevic | |
| 2010/0302123 | A1* | 12/2010 | Knudsen et al. | 343/861 |
| 2010/0309092 | A1 | 12/2010 | Lambacka | |
| 2011/0133994 | A1 | 6/2011 | Korva | |
| 2012/0026066 | A1* | 2/2012 | Leisten | H01Q 1/38 343/895 |
| 2012/0112970 | A1* | 5/2012 | Caballero | H01Q 1/243 343/702 |
| 2012/0119955 | A1 | 5/2012 | Milosavljevic et al. | |
| 2012/0231750 | A1* | 9/2012 | Jin | H01Q 7/005 455/77 |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |
| WO | WO 2011076582 A1 | 6/2011 |
| WO | WO-2011101534 A1 | 8/2011 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

(56) References Cited

OTHER PUBLICATIONS

Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, loannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted 11/04 issue of RF Design (www.rfdesign.com), Copyright 2004, Freescale Semiconductor, RFD-24-EK.
S. Tarvas, et al. "An internal dual-band mobile phone antenna," in 2000 *IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

* cited by examiner

LOOSELY-COUPLED RADIO ANTENNA APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to antenna apparatus for use in electronic devices such as wireless or portable radio devices, and more particularly in one exemplary aspect to an internal multiband antenna for use with conductive enclosures, and methods of tuning and utilizing the same.

DESCRIPTION OF RELATED TECHNOLOGY

Internal antennas are an element found in most modern radio devices, such as mobile computers, mobile phones, Blackberry® devices, smartphones, personal digital assistants (PDAs), or other personal communication devices (PCDs). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used.

Recent advances in the development of affordable and power-efficient display technologies for mobile applications (such as liquid crystal displays (LCD), light-emitting diodes (LED) displays, organic light emitting diodes (OLED), thin film transistors (TFT), etc.) have resulted in a proliferation of mobile devices featuring large displays, with screen sizes of for instance 89-100 mm (3.5-4 in.) in mobile phones, and on the order of 180 mm (7 in.) in some tablet computers. These trends, combined with user demands for robust and ascetically attractive device enclosures, increase the use of metal chassis and all-metal device enclosures. These metal enclosures and components often act as electromagnetic shields and reduce antenna efficiency and bandwidth, which adversely affects operation of internal radio frequency antennas, particularly at low frequencies.

Furthermore, modern third and fourth generation high-speed wireless networks, such as Wideband Code Division Multiple Access (W-CDMA), Universal Mobile Telecommunications System (UMTS), High-Speed Packet Access (HSPA), and 3GPP Long Term Evolution (LTE/LTE-A), require radio devices that operate in multiple frequency bands over a wide range of frequencies (e.g., 700 MHz to 2700 MHz).

Various methods are presently employed to attempt to improve antenna operation with metallic or metalized enclosures. Capacitively fed monopole antennas achieve wide bandwidth using switches. However, the use of electrical switching requires specialized matching, and often results in high electrical losses. Some existing solutions utilize various cut-outs and partial metalized enclosures in order to minimize antenna radiation losses and improve performance. In addition, active switching and tuning circuits require additional components which increase complexity, cost and size of the portable radio device. As the number of supported frequency bands increases (e.g., to support LTE/LTE-A), active switching antennas become more difficult to implement in metalized enclosures while maintaining antenna performance (and obeying aesthetic considerations such as shape and size).

Accordingly, there is a salient need for a wireless multiband antenna solution for e.g., a portable radio device, with a small form factor and which is suitable for use with metal/metalized device enclosures. Ideally, such solution would also offer a lower cost and complexity, as well as supporting multiple frequency bands while maintain good radiation efficiency.

SUMMARY OF THE INVENTION

The present invention satisfies the foregoing needs by providing, inter alia, a space-efficient multiband antenna apparatus, and methods of tuning and use thereof.

In a first aspect of the invention, an antenna apparatus is disclosed. In one embodiment, the apparatus comprises: a loosely coupled main antenna radiator having a single feed point connection; and a diversity antenna element. The antenna apparatus is configured to utilize at least a portion of a metallic enclosure of a host device as a parasitic resonator; and is capable of at least receiving signals in a plurality of frequency bands within both lower and upper operating frequency ranges.

In one variant, the antenna apparatus does not include any tuning circuitry or switches.

In another variant, the host device includes a mobile cellular telephone, and the frequency bands are at least in part compliant with those specified in the Long Term Evolution (LTE) wireless standard.

In yet another variant, the antenna apparatus forms a first parasitic resonator using the main antenna radiator, and a second parasitic resonator using the diversity antenna element.

In a second aspect of the invention, a radio frequency communications device is disclosed. In one embodiment, the device includes: an electronics assembly comprising a ground plane and a feed port; at least partially electrically conductive external enclosure comprising a main portion enclosing the electronics assembly, and a first end cap enclosing a first antenna radiator having a feed structure connected to the feed port. The first antenna radiator is configured to operate in at least a first frequency band; and the first end cap is connected to the ground plane at least at a first location, thereby forming a first parasitic radiator in a second frequency band.

In one variant, the first antenna radiator and the first parasitic radiator form a first multiband antenna apparatus; and the first parasitic radiator is configured to widen an operating bandwidth of the first multiband antenna apparatus.

In another variant, the grounding of the first end cap is configured to increase radiation efficiency of the multiband antenna apparatus.

In another variant, the first end cap is disposed proximate a first end of the device, and the external enclosure is fabricated from metal (e.g., all metal, or a non-conductive carrier and a conductive layer disposed thereon).

In yet another variant, the main portion is connected to ground in at least one location; and the connection of the first end cap to the ground plane is effected via the main portion.

In a third aspect of the invention, a multiband antenna apparatus for use in a radio communications device is disclosed. In one embodiment, the device has at least partially conductive external enclosure, and the antenna apparatus comprising a directly fed radiator structure having a feed portion configured to be connected to feed port of the radio communications device. The directly fed radiator structure is operable in at least a first frequency band and configured to be electromagnetically coupled to an end cap portion of the external enclosure; the end cap is electrically connected to a ground plane of the radio device via a ground structure; the grounding of the end cap is configured to widen operating bandwidth of the multiband antenna apparatus; and the enclosing of the directly fed radiator structure by the end cap and the grounding of the end cap cooperate to form a parasitically-fed radiator of the antenna apparatus in a second frequency band.

In one variant, the grounding of the end cap is configured to increase radiation efficiency of the multiband antenna apparatus, and the second band is lower than the first band.

In another variant, the end cap is configured to substantially enclose the directly fed radiator structure on at least on five sides.

In yet another variant, the directly fed radiator structure includes a first portion configured substantially parallel to the ground plane, and a second portion configured substantially perpendicular to the ground plane. The antenna includes a parasitic radiator disposed proximate to the feed portion and configured to form an electromagnetically coupled resonance in at least a third frequency band.

In a fourth aspect of the invention, a method of expanding operational bandwidth of a multiband antenna useful in a radio device is disclosed. In one embodiment, the device has an at least partially conductive external enclosure, and the method includes: energizing a first radiator structure in at least a first frequency band by effecting an electric connection between the first radiator and a feed port of the radio device; and energizing a second antenna radiator structure in at least a second frequency band by: (i) electromagnetically coupling the second radiator structure to the feed port; and (ii) effecting an electric ground connection between the second radiator structure and a ground plane of the radio device.

In one variant, the second radiator structure includes an end cap portion of the external enclosure; and the end cap portion is connected to the ground plane at least at a first location that is selected to widen operating bandwidth of the multiband antenna.

In a fifth aspect of the invention, an antenna radiator structure for use in a wireless device is disclosed. In one embodiment, the structure includes: a directly fed radiating element in electrical communication with a feed structure; and a second radiating element with a slot formed therein. The directly fed radiating element and the second radiating element are configured to be disposed in a substantially perpendicular orientation when installed within a host device enclosure.

In one variant, the structure further includes a parasitic element adapted for communication with a ground of the host device, the parasitic element configured for placement proximate the feed structure and to resonate at a frequency other than that of the directly fed radiating element or the second radiating element.

In another variant, the slot is configured to create a first resonant frequency of a high frequency band associated with the structure. The directly fed radiating element includes an end portion used to tune a first harmonic of a low band resonance into the high frequency band, thus forming a second high frequency resonance.

In another aspect of the invention, a method of operating a multiband antenna apparatus is disclosed. In one embodiment, the antenna apparatus is for use in a portable radio device, and the method includes causing a resonance in a parasitic resonator of the antenna to create a frequency band outside the main antenna band(s).

In yet another aspect of the invention, a method of tuning a multiband antenna apparatus is disclosed.

Further features of the present invention, its nature and various advantages will be more apparent from the accompanying drawings and the following detailed description.

BRIEF DESCRIPTION OF THE DRAWINGS

The features, objectives, and advantages of the invention will become more apparent from the detailed description set forth below when taken in conjunction with the drawings, wherein.

Figure 1:
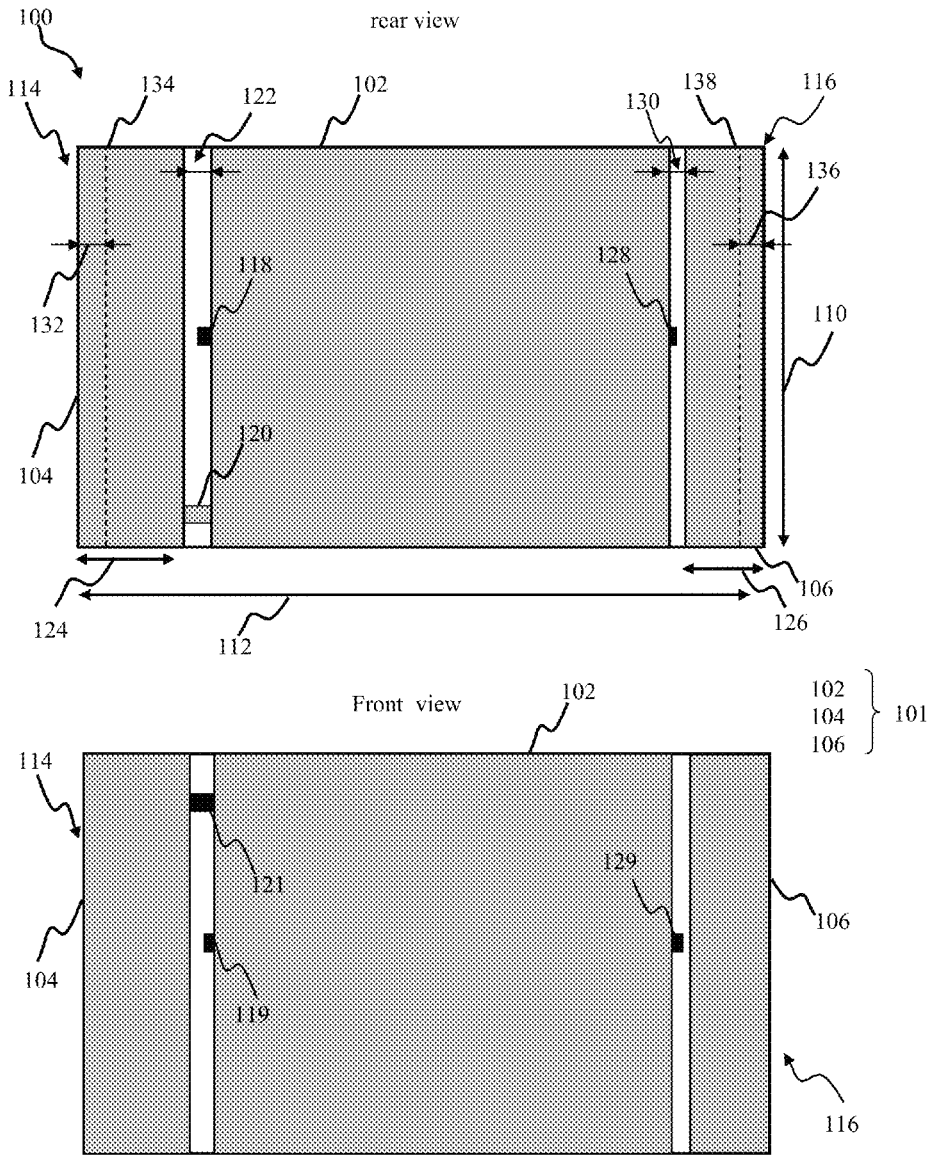
FIG. 1 provides front and rear elevation views of a mobile device comprising a conductive enclosure and internal antenna apparatus configured according to one embodiment of the invention.

All Figures disclosed herein are © Copyright 2011 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," "antenna system," "antenna assembly", and "multi-band antenna" refer without limitation to any apparatus or system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna or portion thereof.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), TD-LTE, analog cellular, CDPD, satellite systems such as GPS, millimeter wave or microwave systems, optical, acoustic, and infrared (i.e., IrDA).

Overview

The present invention provides, in one salient aspect, a multiband antenna apparatus for use in a mobile radio device having an electrically conductive enclosure. The exemplary embodiments of the antenna apparatus described herein advantageously offer reduced complexity and cost, and improved antenna performance, as compared to prior art solutions. In one implementation, the antenna apparatus comprises a main antenna radiator disposed on one end of the device enclosure, and diversity or a multiple-input multiple-output (MIMO) antenna radiator disposed on opposite end. The mobile radio device comprises a metallic enclosure (e.g., a fully metallic, or an insulated metal carrier) which comprises a main portion and two antenna cover portions (caps) that substantially completely enclose the main and the diversity antenna radiating elements, respectively. Both antenna caps are separated from the main enclosure portion by a narrow gap extending along the circumference of the device. In order to reduce losses due to handling during operation, the surface of metal cover may be comprise a non-conductive layer, e.g., plastic film.

The main antenna radiator comprises a loosely-coupled antenna, which is also referred to as the ring antenna. The feed of the main antenna is connected to the device RF feed structure, thus requiring only a single connection between the main antenna radiator and the device electronics. The main portion of the device conductive enclosure is connected to ground at one or more predetermined locations. In one implementation, the main portion is grounded at four points (two per side, one on each end) disposed substantially along a longitudinal axis of the enclosure. In another implementation, additional grounding points are used, such as, for example, proximate the device sides.

The cap portion that covers the main antenna feed is loosely coupled to the feed element, thus forming a parasitic antenna resonator. In some implementations, the antenna cap is connected to device ground plane in order to adjust antenna resonant frequency in low frequency band, to widen the antenna bandwidth, and to enhance radiation efficiency of the antenna.

Advantageously, the coupling of the feeding element to the grounded (short-circuited) metallized cover portion surrounding the feeding element and being a part of metallized phone enclosure enables the cover portion to operate as a parasitic antenna resonator at low frequencies. Furthermore, coupling of the main and diversity antenna to the device electronics described herein is much simplified, as only a single feed connection is required (albeit not limited to a single feed).

In one particular implementation, a high frequency band parasitic resonator structure is disposed proximate to the directly fed radiator structure of the feeding element radiator in order to widen antenna operating bandwidth. The parasitic structure is located along one side of the device enclosure and is galvanically connected to ground.

Methods of tuning and operating the antenna apparatus are also disclosed.

DETAILED DESCRIPTION OF EXEMPLARY EMBODIMENTS

Detailed descriptions of the various embodiments and variants of the apparatus and methods of the invention are now provided. While primarily discussed in the context of mobile devices, the apparatus and methodologies discussed herein are not so limited. In fact, many of the apparatus and methodologies described herein are useful in any number of complex antennas, whether associated with mobile or fixed devices (e.g., base stations or femtocells), cellular or otherwise.

Exemplary Antenna Apparatus

Figure 2:
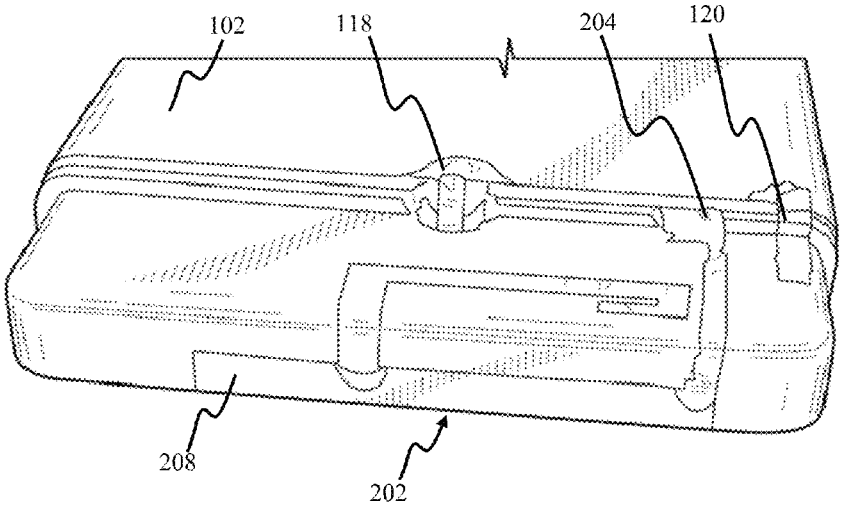
FIG. 2 is an end perspective view of one embodiment of main antenna radiator useful with the conductive device enclosure of the embodiment shown in FIG. 1.
Figure 3:
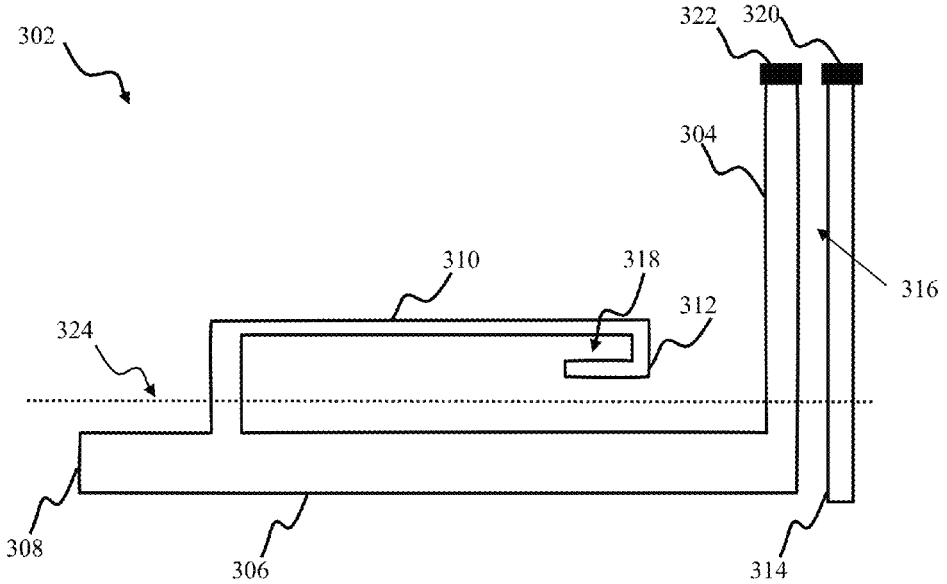
FIG. 3 is a top plan view of the main antenna element (showed in planar disposition before folding).

Referring now to FIGS. 1 through 3, various embodiments of the radio antenna apparatus of the invention are described in detail. One exemplary configuration of the antenna apparatus for use in a mobile radio device is presented in FIG. 1. The host mobile device 100 comprises an external enclosure 101, having width 110 and length 112, and fabricated from metal, such as aluminum, steel, copper, or other suitable alloys. It is appreciated that while this device is shown having a generally rectangular form, the invention may be practiced with devices that possess other form factors; e.g., square, oval, etc.

A printed circuit board (PCB), comprising radio frequency electronics and a ground plane, is disposed within the device 100. In one variant, the enclosure 101 is fabricated using a plastic carrier structure with a metalized conductive layer (e.g., copper alloy) disposed on its external surface.

As shown in FIG. 1, the enclosure 101 comprises a main portion 102 and two end cap portions; i.e., the main antenna end cap 104 and the diversity antenna end cap 106. In one variant, only a single end cap (e.g., 104) is used, and the main portion includes both portions 102, 106. In the embodiment of FIG. 1, the main end cap is disposed proximate a bottom end of the radio device 100, while the diversity end cap covers the top end of the device. The length 124, 126 of each of the main antenna end cap 104 and the diversity antenna end cap 106 is about 13 mm (0.5 in), although other values may be used with equal success. In one variant, the end caps 104, 106 are disposed proximate to left and right sides of the device.

In one approach, the end caps are fabricated from solid metal, and are spaced from the feeding element by a predetermined distance (typically on the order of 1 mm). In another approach, the end caps comprise a metal covered plastic, fabricated by any suitable manufacturing method (such as, for example laser direct structuring, (LDS)). In this variant, the plastic thickness provides sufficient gap between the metal end cap portion and the feed structure; hence, additional spacing is not required.

The first end cap 104 is separated from the main portion 102 by a gap 122, and the other end cap 106 is separated from the main portion 102 by a gap 130. In the embodiment shown in FIG. 1, the exemplary enclosure 101 is 57 mm (2.3 in) wide, 120 mm (4.7 in) long and 10 mm (0.4 in) thick. The gaps 122, 130 are 3 mm (0.118 in) and 1.5 mm (0.069 in) wide, respectively. The gaps 122, enable tuning of the antenna resonant frequency, bandwidth, and the radiation efficiency. Typically, a narrower gap corresponds to a lower resonant frequency, lower efficiency, and narrower bandwidth. It will be appreciated by those skilled in the arts given the present disclosure that the above dimensions correspond to one particular antenna/device embodiment, and are configured based on a specific implementation and are hence merely illustrative of the broader principles of the invention.

The main portion 102 of the enclosure is connected to the ground plane device (not shown) at multiple locations 118, 128, 119, 129 in order to achieve good coupling, and to minimize electrostatic discharge (ESD) problems. In the embodiment of FIG. 1, the ground locations are disposed along a longitudinal axis of the enclosure, with two (2) of the four (4) locations (the location 118 near the bottom end and the location 128 near the top end) grounding the top surface of the enclosure, and with two of the locations (the area 119 near the bottom end and the area 129 near the top end) 118, 128 grounding the bottom surface of the enclosure. The ground connections 118, 119, 128, 129 are effected via any method suitable for creating a high quality ground, including but not limited to a solder or brazed connection, a ground screw, a clip, a spring-loaded pin, etc.

In one variant, additional ground contacts (not shown) are disposed along the left and right sides of the main portion in order to minimize potential occurrence of unwanted resonances, thereby improving the robustness of antenna operation.

The radio device 100 comprises a main antenna apparatus 114 and a diversity antenna apparatus 116, disposed proximate the bottom and top ends of the device, respectively, as shown in FIG. 1. In another embodiment, the locations of the main antenna and the diversity antenna are reversed from the foregoing. The first end cap 104 encloses the main antenna feeding element, thus forming a parasitic radiator portion of the main antenna 104. Similarly, the second end cap 106 covers the diversity antenna feeding element, thus forming a parasitic radiator portion of the diversity antenna 106.

The main antenna 114, in the embodiment shown in FIG. 1, is configured to operate in multiple (in this case five) frequency bands; i.e., 850, 900, 1800, 1900 and 2100 MHz. The diversity antenna 114, in the embodiment shown in FIG. 1, is similarly configured to operate in the above five frequency bands, although it is not necessary that the number of bands of the two antennas be the same or related. The ground clearances for both antennas 114, 116 are about 12 mm (0.5 in) in the illustrated embodiment.

The main antenna end cup 104 is connected to PCB ground at a grounding structure 121. As shown in the embodiment of FIG. 1, the grounding structure 121 connects the end cap 104 to the main enclosure portion 102 in order to achieve the end cap 104 grounding. In another implementation, the grounding structure 121 comprises a direct connection to the device PCB ground by way of a wire, trace, or a flex or other type of cable. The location of the grounding structure 121 is selected such that to form a resonance at a desired frequency within the conductive portion of the end cap 104.

In some embodiments, the diversity antenna 116 comprises a capacitively fed monopole antenna, such as for example that described in PCT Patent Publication No. 2011/101534, entitled "ANTENNA PROVIDED WITH COVER RADIATOR", incorporated herein by reference in its entirety.

Referring now to FIG. 2, one embodiment of a feeding element of the antenna of the invention is shown and described in detail. The antenna feeding structure 202 comprises a directly fed element 208 coupled to the device feed port via the feed structure 204. The direct-feed radiator of the embodiment shown in FIG. 2 is disposed parallel to the end side of the main end cap 104 (not shown), and is spaced from it (by an approximately 1 mm gap in this embodiment) in order to provide sufficient electromagnetic coupling. The conductive end cap 104 is electromagnetically coupled to the device feed via the feeding element 208, thereby creating a parasitic resonator in the low frequency range. In the antenna embodiment of FIGS. 1-2, the feeding structure 202 is configured to resonate at frequencies of 900 MHz, 1800 MHz, 1900 MHz, and 2100 MHz, while the end-cap 104 resonates at about 850 MHz.

In one embodiment, the antenna feeding structure 202 comprises a parasitically coupled feed structure that is electrically connected to the main enclosure portion (or PCB ground) via the grounding structure 120, and which forms a parasitically coupled resonance in the high frequency range, thereby increasing the antenna operating bandwidth.

As used herein, the terms "low frequency" and "high frequency" are used to describe a first frequency range which is lower in frequency than the second range, respectively, and which may contain multiple bands. In the exemplary embodiment, the lower range extends from about 800 MHz to about 950 MHz, while the high or upper frequency range extends from about 1700 MHz to about 2700 MHz. However, the invention described herein is not so limited, and other frequency band configurations (including those which overlap with one another) may be used consistent with the invention, based on the specific application. The main antenna apparatus 114, including the feeding element 202 and the main end cap radiator 104, comprises a loosely-coupled antenna structure, which is also referred to as a "ring antenna". The ring antenna is formed, in one embodiment, by electromagnetically coupling the directly fed radiator 208 to the short-circuited conductive end cap enveloping the radiator surrounding the feeding element, and by virtue of being a part of metallized phone enclosure. In one implementation, only a single electrical connection between the device PCB and the antenna radiator is advantageously required (i.e., the feed connection 204), thereby simplifying manufacturing and construction.

FIG. 3 illustrates one exemplary embodiment of the main antenna radiator (e.g., the radiator 202 in FIG. 2) for use with the loosely-coupled antenna apparatus (e.g., the antenna 114 of FIG. 1), shown in a planar disposition; i.e., before folding for installation in the mobile device 100. The radiator structure 302 comprises the directly fed radiator portion 306, 308 (that is connected to the device feed port 322 via the feed structure 304), and a C-element 310, 312 which forms a slot 318 therein. When installed, the antenna radiator 302 is folded along the dotted line 324 so that the radiator structure 306, 308 and the C-element 310, 312 are disposed perpendicular to one another within the device enclosure. In one implementation, the radiator 302 further comprises a parasitic element 314 that is connected to the device ground via the grounding structure 320. The total length of all radiator elements (304, 306, 308, 310, 312) determines a first resonant frequency FL1 within the low frequency range. The slot 318 formed by the design of the feeding element creates the first resonant frequency of the high band (FH1). The end portion of the radiator structure 308 is used to tune a first harmonic of the low band resonance into the high band, thus forming a second high frequency resonance (FH2).

The parasitic element 314 is disposed proximate the feed structure 304 so as to ensure sufficient electromagnetic coupling to the antenna feed port via the slot 316 formed between the elements 304, 314, thus forming a third high frequency resonance (FH3).

As will be understood by those skilled in the arts when given this disclosure, the radiator structure of FIG. 3 presents one exemplary embodiment, and many other antenna radiator configurations may be used. By way of example, the length of the parasitic radiator 314 can be reduced, so that the radiator 314 is disposed completely co-planar with the antenna radiator elements 310, 312.

Performance

Figure 4:
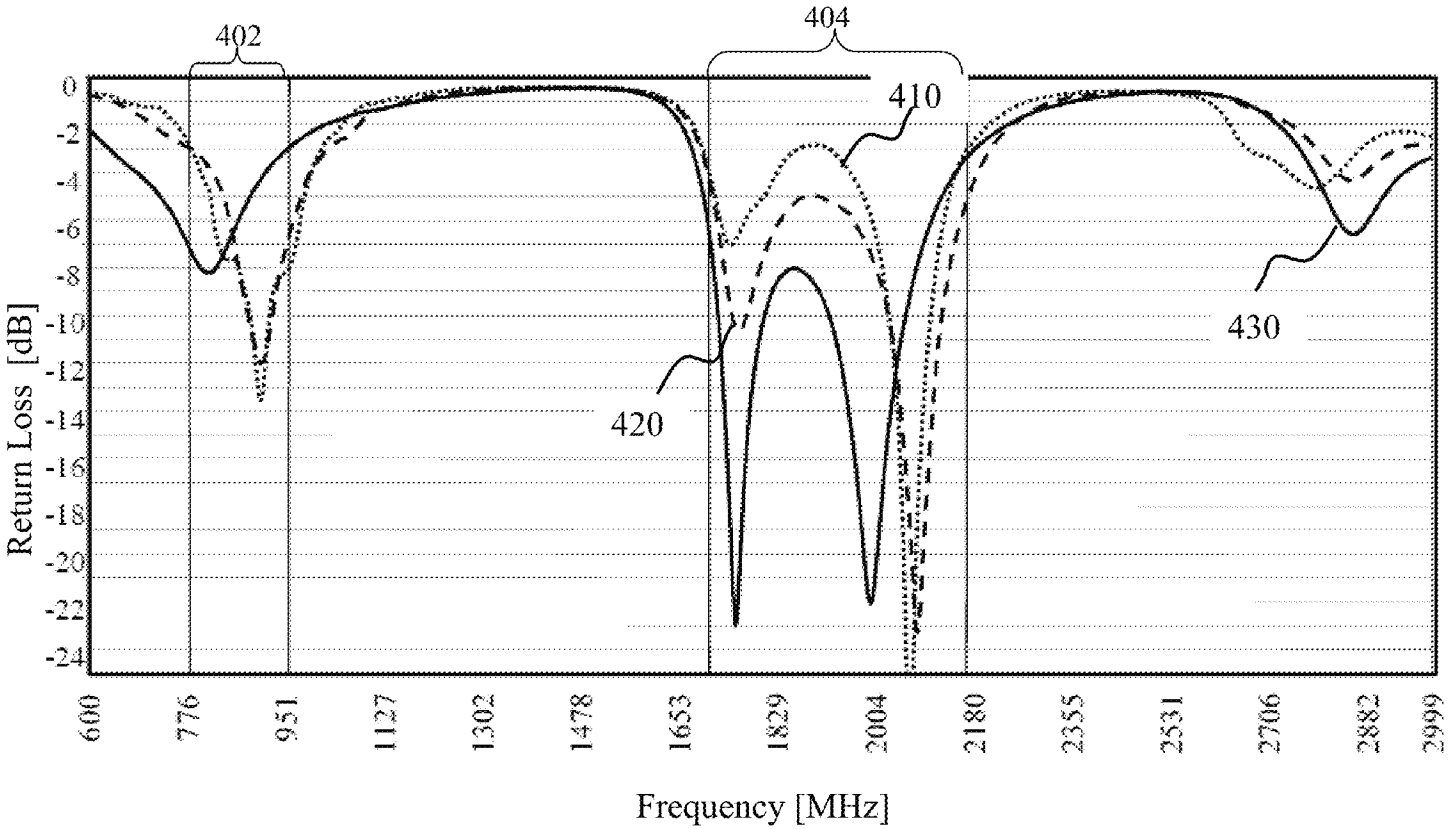
FIG. 4 is a plot of measured input return loss obtained with an exemplary five-band main antenna apparatus configured in accordance with the embodiment of FIGS. 1-3 and coupled to the enclosure conductive cover, for the following configurations: (i) measured in free space; (ii) measured according to CTIA v3.1 beside head, right cheek; and (iii) measured according to CTIA v3.1 beside head with hand, right cheek.
Figure 5:
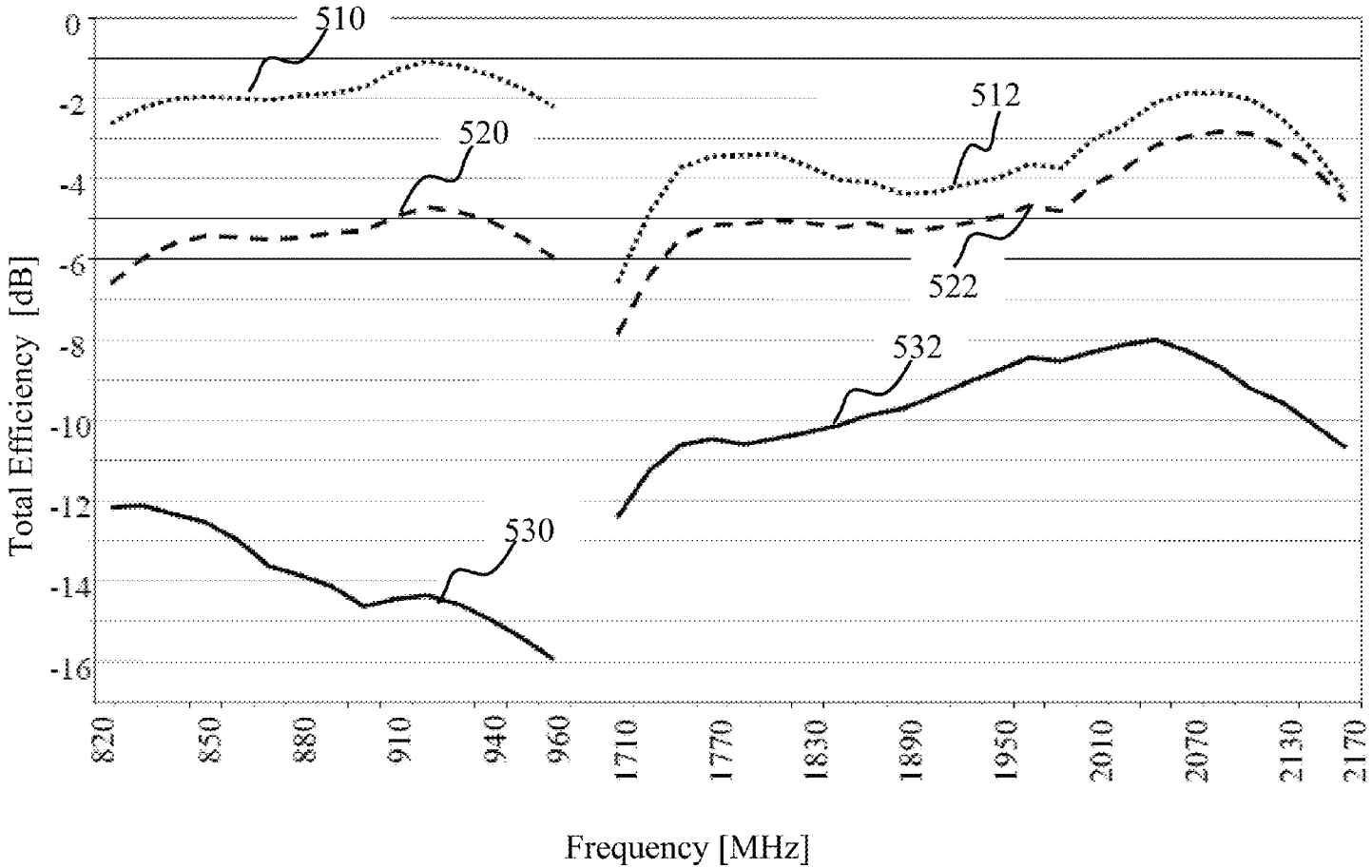
FIG. 5 is a plot of total efficiency obtained with an exemplary five-band main antenna apparatus configured in accordance with the embodiment of FIGS. 1-3 and coupled to the conductive cover, for the following configurations: (i) measured in free space; (ii) measured according to CTIA v3.1 beside head, right cheek; and (iii) measured according to CTIA v3.1 beside head with hand, right cheek.
Figure 6:
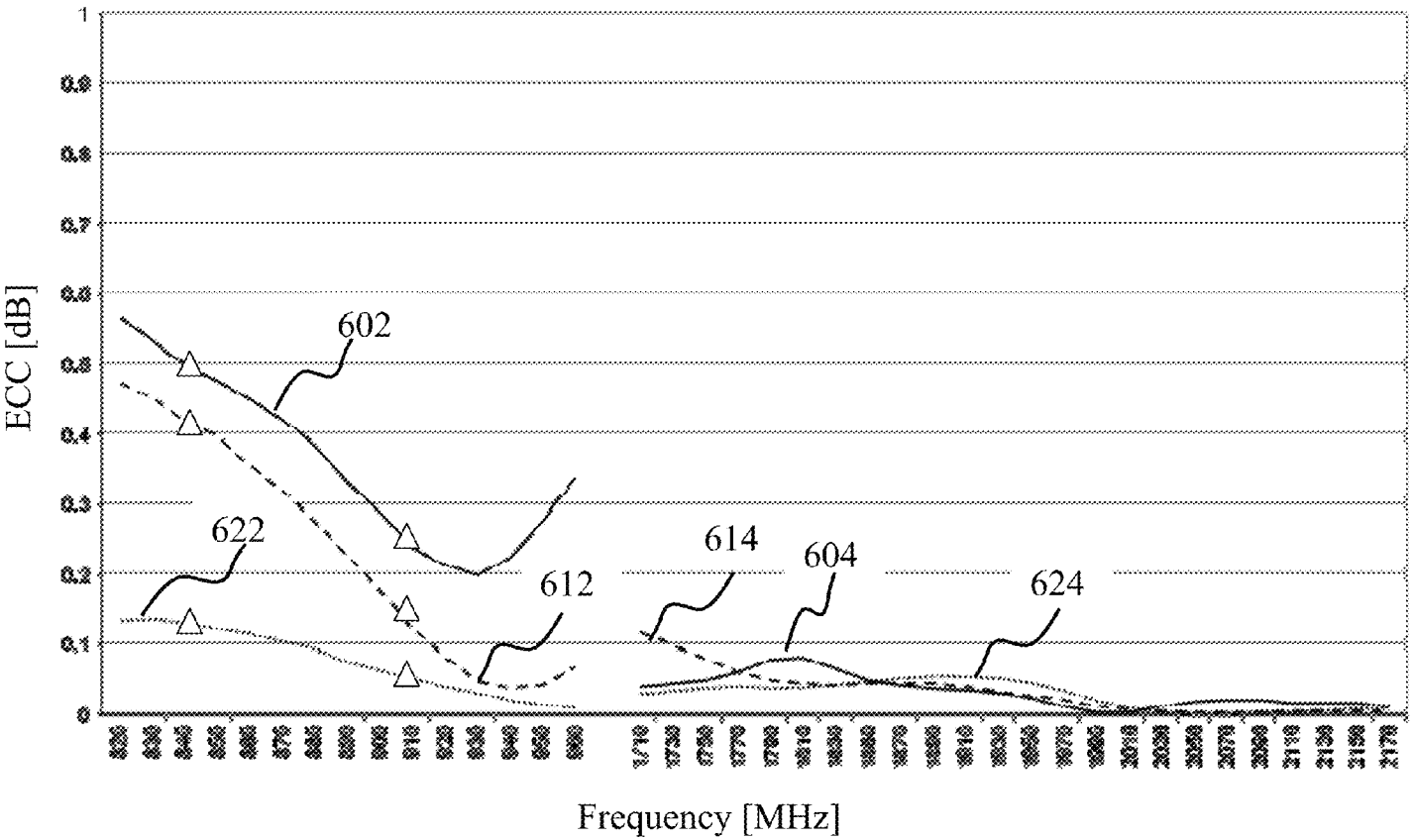
FIG. 6 is a plot of envelope correlation coefficient (ECC) between the main and diversity antennas obtained with an exemplary multi-band antenna apparatus configured in accordance with the embodiment of FIG. 1, for the following configurations: (i) measured in free space; (ii) measured according to CTIA v3.1 beside head, right cheek, and (iii) measured according to CTIA v3.1 beside head with hand, right cheek.

FIGS. 4 through 6 present performance results obtained during simulation and testing by the Assignee hereof of an exemplary antenna apparatus constructed according to one embodiment of the invention.

FIG. 4 is a plot of return loss S11 (in dB) as a function of frequency, measured with the five-band multiband antenna constructed similarly to the embodiment depicted in FIGS. 1-3, for the following measurement configurations: (i) free space; (ii) measured according to CTIA 3.1 specification beside head, right cheek; and (iii) measured according to CTIA 3.1 specification beside head, with hand grasping the device by the right cheek.

The five antenna frequency bands in this sample include two 850 MHz and 900 MHz low frequency bands, and three upper frequency bands (i.e., 1,710-1,880 MHz, 1,850-1,990 MHz, and 1,920-2,170 MHz). The solid lines designated with the designators 402 in FIG. 4 mark the boundaries of the exemplary lower frequency band, while the lines designated with the designator 404 mark the boundaries of the higher frequency band.

The curves marked with designators 410, 420, 430 in FIG. 4 correspond to the measurements taken (i) in free space; (ii) according to CTIA 3.1 specification beside head, right cheek; and (iii) according to CTIA 3.1 specification beside head, with hand grasping the device by the right cheek, respectively.

Data presented in FIG. 4 demonstrate that the exemplary antenna comprising a main radiator and a loosely coupled conductive end cap radiator advantageously reduces free space loss, particularly in the lower frequency range (here, 770 MHz to 950 MHz). Furthermore, the high frequency bandwidth of the loosely coupled main antenna (about 460 MHz), configured according to the invention, advantageously exceeds the high frequency bandwidth compared to the metal cover antenna solutions of the prior art.

Exemplary antenna isolation data (not shown) obtained by the Assignee hereof reveals about 9 dB, 17 dB of antenna isolation in the lower and upper frequency ranges, between the main and the diversity antennas. Such increased isolation advantageously reduces potential detrimental effects due to e.g., Electrostatic Discharge (ESD) during device operation.

FIG. 5 presents data regarding measured efficiency for the same antenna as described above with respect to FIG. 4. Efficiency of an antenna (in dB) is defined as decimal logarithm of a ratio of radiated to input power:

$$AntennaEfficiency = 10\log_{10}\left(\frac{\text{Radiated Power}}{\text{Input Power}}\right) \quad \text{Eqn. (1)}$$

An efficiency of zero (0) dB corresponds to an ideal theoretical radiator, wherein all of the input power is radiated in the form of electromagnetic energy.

Measurement presented in FIG. 5 are taken as follows: (i) free space, depicted by the curves denoted 510, 512; (ii) measured according to CTIA 3.1 specification beside head, right cheek depicted by the curves denoted 520, 522; and (iii) measured according to CTIA 3.1 specification beside head, with hand by right cheek, depicted by the curves denoted 530, 532.

The total efficiency measurements presented in FIG. 5, show free space efficiency between −3 and −1 dB in the lower frequency band, and between −4 and −2 dB in the high frequency band. Efficiency measurements taken in the presence of dielectric loading (the curves 520, 522, 530, 532) show a reduction in efficiency, compared to the free space measurements (the curves denoted 510, 512). However, the efficiency reduction of the loosely-coupled conductive end cap antenna of the invention is substantially smaller, particularly in the frequency range from 820 MHz to 960 MHz, when compared to the capacitively coupled diversity antenna of the prior art. Comparison between the two antenna responses demonstrates a substantially higher efficiency (3 dB to 7 dB) of the main loosely coupled end cap antenna of the invention in free space and beside the head, as compared to the capacitively fed antenna of the prior art.

FIG. 6 presents data regarding measured envelope correlation coefficient (ECC) between the exemplary implementation of the main loosely-coupled antenna of the present invention and capacitively coupled monopole diversity antenna of prior art. The curves marked with designators 602, 604 correspond to the measurements taken in free space; the curves marked with designators 612, 614 correspond to the measurements taken according to CTIA 3.1 specification beside head, right cheek; and the curves marked with designators 622, 624 correspond to the measurements taken according to CTIA 3.1 specification beside head with hand by the right cheek (BHHR). Data shown in FIG. 6 advantageously exhibit low ECC between the main and the diversity antenna at high frequencies in all configurations, and in the lower frequency band when operating in BHHR CTIA 3.1 configuration, that closely reproduces typical operating conditions during device use.

The data presented in FIGS. 4-6 demonstrate that a multiband antenna comprising loosely coupled conductive end cap acting as a parasitic resonator is capable of operation within a wide frequency range; e.g., covering an exemplary lower frequency band from 824 to 960 MHz, as well as a higher frequency band from 1,710 MHz to 2,170 MHz, while maintaining low losses and high radiation efficiency as compared to a capacitively coupled antenna designs of the prior art.

Furthermore, a multiband antenna configured according to the invention advantageously does not require matching circuitry (thereby saving cost and space), and comprises a passive structure that does not use active switching, thus further reducing radiation losses, antenna size, and cost. A single connection to the device electronics is also utilized, which simplifies antenna installation and increases operational robustness. Increased bandwidth, particularly at lower frequencies, lower loses and improved isolation allow antenna multiband operation with a fully metallic device covers, while maintaining the same performance, device size, and/or antenna cost as with non-metallized or only partially metallized device covers.

This capability advantageously allows operation of a portable computing device with a single antenna over several mobile frequency bands such as GSM850, GSM900, GSM1900, GSM1800, PCS-1900, as well as LTE/LTE-A and/or WiMAX (IEEE Std. 802.16) frequency bands. Furthermore, the use of a separate tuning branch enables formation of a higher order antenna resonance, therefore enabling antenna operation in an additional high frequency band (e.g., 2500-2600 MHz band). Such capability further expands antenna uses to, inter alia, Wi-Fi (802.11) and additional LTE/LTE-A bands. As persons skilled in the art will appreciate, the frequency band composition given above may be modified as required by the particular application(s) desired, and additional bands may be supported/used as well.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

In one approach, a half-cup implementation may be used so that there is no metal on one side (for example, the top side of the device that, typically, comprises a display While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A communications device, comprising:

a metallic device enclosure comprising a main portion, a first antenna cover portion, and a second antenna cover portion, the first and second antenna cover portions disposed on opposing sides of the metallic device enclosure and separated from the main portion by a gap extending along the circumference of the communications device, the main portion connected to a ground at one or more predetermined locations;

a main antenna radiator disposed on a first end of the metallic device enclosure enclosed within the first antenna cover portion, the main antenna radiator comprising a C-element and a feed element connected to a feed structure of the communications device, the first antenna cover portion electromagnetically coupled to the feed element in order to form a parasitic antenna resonator, the main antenna radiator folded such that the feed element is disposed perpendicular to the C-element within the metallic device enclosure; and a multiple-input multiple-output (MIMO) antenna radiator disposed on a second end of the metallic device enclosure, the MIMO antenna radiator being enclosed within the second antenna cover portion;

wherein the first and second ends are disposed on opposing sides of the metallic device enclosure.

2. The communications device of claim 1, wherein the main antenna radiator radiates frequencies at a higher range than the parasitic antenna resonator.

3. The communications device of claim 1, wherein the metallic device enclosure comprises an insulated metallic carrier.

4. A radio frequency communications device, comprising:

an electronics assembly comprising a ground plane, and a feed port;

at least partially electrically conductive external enclosure comprising a main portion enclosing the electronics assembly, and a first end cap disposed proximate a first end of the device, the first end cap enclosing a first antenna radiator having a feed structure connected to the feed port;

wherein:

the first antenna radiator is configured to operate in at least a first frequency band, and the first end cap is physically connected to the ground plane at least at a first location, thereby forming a first parasitic radiator in a second frequency band;

the at least partially electrically conductive enclosure further comprising a second end cap disposed proximate a second end of the device, the second end being opposite the first end, the second end cap enclosing a second antenna radiator having a feed structure connected to the feed port and being configured to operate in at least the first frequency band;

the first end cap is separated from the main portion by a first gap that extends substantially around a circumference of the device; and the second end cap is separated from the main portion by a second gap that extends substantially around the circumference of the device.

5. The device of claim 4, wherein:

the first antenna radiator and the first parasitic radiator are configured to form a first multiband antenna apparatus; and the first parasitic radiator is configured to widen an operating bandwidth of the first multiband antenna apparatus.

6. The communications device of claim 4, wherein the grounding of the first end cap is configured to increase radiation efficiency of the first parasitic radiator.

7. The communications device of claim 4, wherein the external enclosure is fabricated from metal.

8. The communications device of claim 7, wherein the external enclosure comprises a non-conductive carrier and a conductive layer disposed thereon.

9. The communications device of claim 7, wherein:

the main portion is connected to the ground plane in at least one location; and the connection of the first end cap to the ground plane is effected via the main portion.

10. The communications device of claim 7, wherein the first end cap is connected to the ground plane via a direct connection.

11. The communications device of claim 4, wherein:

the second end cap is connected to the ground plane, at least at a second location, thereby forming a second parasitic radiator in the second frequency band;

the second antenna radiator and the second parasitic radiator are configured to form a second multiband antenna apparatus; and the second parasitic radiator is configured to widen an operating bandwidth of the second multiband antenna apparatus.

12. A multiband antenna apparatus for use in a radio communications device having a partially conductive external enclosure, the antenna apparatus comprising a directly fed radiator structure, the multiband antenna apparatus having a feed portion configured to be connected to feed port of the radio communications device;

wherein:

the directly fed radiator structure is operable in at least a first frequency band and configured to be electromagnetically coupled to an end cap of the external enclosure;

the end cap is electrically connected to a ground plane of the radio communications device via a ground structure, the end cap being separated from a main portion of the external enclosure by a gap that extends around a circumference of the radio communications device;

the grounding of the end cap is configured to widen an operating bandwidth of the multiband antenna apparatus;

the directly fed radiator structure is enclosed by the end cap and the grounding of the end cap cooperate to form a parasitically-fed radiator of the antenna apparatus in a second frequency band; and the end cap is configured to substantially enclose the directly fed radiator structure on at least five sides.

13. The antenna apparatus of claim 12, wherein the grounding of the end cap is configured to increase a radiation efficiency of the multiband antenna apparatus.

14. The antenna apparatus of claim 12, wherein the second band is lower than the first band.

15. The antenna apparatus of claim 12, wherein the ground plane is spaced from the directly fed radiator structure by a predetermined ground clearance.

16. The antenna apparatus of claim 12, wherein the directly fed radiator structure comprises a first portion configured substantially parallel to the ground plane, and a second portion configured substantially perpendicular to the ground plane.

17. The antenna apparatus of claim 12, wherein the antenna comprises a parasitic radiator disposed proximate to the feed portion and configured to form an electromagnetically coupled resonance in at least a third frequency band.

18. The antenna apparatus of claim 17, wherein the second frequency band is lower than the third frequency band.

19. The antenna apparatus of claim 12, wherein the ground structure comprises at least a portion of a main portion of the external enclosure.

20. The antenna apparatus of claim 12, wherein the ground structure comprises a direct connection to the ground plane.

21. The antenna apparatus of claim 12, further comprising a diversity radiator structure.

22. The antenna apparatus of claim 21, wherein the directly fed radiator structure and the diversity radiator structure are disposed on opposite ends of the external enclosure.

23. The antenna apparatus of claim 22, further comprising a second end cap, the second end cap is configured to substantially enclose the diversity radiator structure, the second end cap being separated from the main portion of the external enclosure by a second gap that extends around the circumference of the radio communications device.

* * * * *